United States Patent [19]

Laupper

[11] 4,331,321

[45] May 25, 1982

[54] LIFTING DEVICE

[76] Inventor: Anton Laupper, Im Malarsch 4, 9494 Schaan, Liechtenstein

[21] Appl. No.: 149,682

[22] Filed: May 14, 1980

[30] Foreign Application Priority Data

May 22, 1979 [AT] Austria ..... 3770/79

[51] Int. Cl.[3] ..... B66F 3/00

[52] U.S. Cl. ..... 254/134

[58] Field of Search ..... 254/133, 134

[56] References Cited

U.S. PATENT DOCUMENTS

| | | | |
|---|---|---|---|
| 1,727,914 | 9/1929 | Templeton et al. | 254/134 |
| 2,675,132 | 4/1954 | Susil | 254/134 X |
| 3,165,295 | 1/1965 | Nolden | 254/134 X |
| 3,232,380 | 2/1966 | Hansen . | |

FOREIGN PATENT DOCUMENTS 1180043 2/1970 United Kingdom .

*Primary Examiner*—Robert C. Watson

*Attorney, Agent, or Firm*—Toren, McGeady & Stanger

[57] ABSTRACT

A lifting device for transporting loads includes a vertical support structure and a horizontally extending cantilevered support arm which is attached to the support structure by a hooked portion engaging in a slot with simultaneous engagement of a bolt within an aperture. The hooked portion and slot and the bolt and aperture may each be defined, respectively, on opposite ones of the contact plate and the support structure in order that they may be engaged to removably mount the cantilevered support arm on the support structure.

6 Claims, 5 Drawing Figures

LIFTING DEVICE

The present invention relates to lifting devices for supporting and/or transporting a load, such as fork lifts or the like, and more particularly to a mechanism for releasably attaching a horizontally extending cantilevered support arm from a vertically extending adjustable lifting structure.

In the prior art, various types of lifting devices having cantilevered support arms are known wherein a more or less rigid connection is usually provided between the lifting structure and the horizontal support arm.

In such known devices, a fork-lift auxiliary attachment is provided at the vertically adjustable lifting structure wherein centering may be effected by means of a pair of bolt-shaped projections. Affixation of the added auxiliary attachment is achieved by the use of pawls. Appropriate supporting arms which may be swivelled and shifted are attached to the auxiliary device. Therefore, in devices of this type, a separate auxiliary structure is necessary and as a result a rather significant mechanical effort is required in order to attach the two supporting arms to the lifting structure. If the arrangement of the support arms must be changed or if other supporting arms are to be installed, there then is required extensive assembly work. Alternatively, it may be required that several such auxiliary devices for different areas of application must be made available. However, other devices must then be removed.

It should also be noted that another significant disadvantage of this type of device is that pawls forming the actual locking mechanism merely enclose the lifting structure due to their own weight. Additionally, an arrangement of appropriate springs could also be utilized, but this again will generally involve additionally mechanical parts.

Accordingly, it is the task of the present invention to provide a structurally simple device for effecting connection between a horizontally cantilevered support arm and a corresponding vertically extending lifting structure.

SUMMARY OF THE INVENTION

In accordance with the present invention, an end of a horizontally extending cantilevered support arm which faces toward the vertical lifting structure is provided with a contact plate which projects above the support arm perpendicularly to the longitudinal extension thereof. A generally L-shaped or hooked suspension portion may be provided either on the support structure or on the contact plate in order to engage within a slot formed in the other of the support structure or the contact plate. Arranged in the vicinity of the bottom peripheral area of the contact plate there is also provided a bolt which is affixed to either the contact plate or the support structure with an aperture being provided on the other in order to engage the bolt therein when the support arm is mounted upon the support structure with the hooked suspension portion engaged within the slot.

As a result of these measures, each individual support arm may be maintained in a desired position by means of a suspension mounting with appropriate centering so that no special additional connecting devices in the form of screws or the like will be necessary. Additionally, there exists the possibility, depending upon the applications to which the lifting device is to be directed, for differently constructing supporting arms to be used, especially since substitution and reattachment of one support arm for another becomes rather simple. As a result of the interchangeability of the arrangement, there is also provided the possibility to effect different variations of suspension portions in order to effect different adjustments for different shapes and types of loads which must be lifted. Due to the construction, the material expenditure for the supporting arms is quite small and storage of different supporting arms becomes quite simple since they will require little space.

In the embodiment according to the present invention, involuntary loosening of the connection will not occur because in order to release a support arm it is necessary that it be lifted at its free cantilevered end while also being pulled outwardly in a longitudinal direction. With the bolt provided on the support arm or on the lifting structure, not only will the special position of the support be centered, but there will also be provided a protective mechanism against unhooking of the suspension portion.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
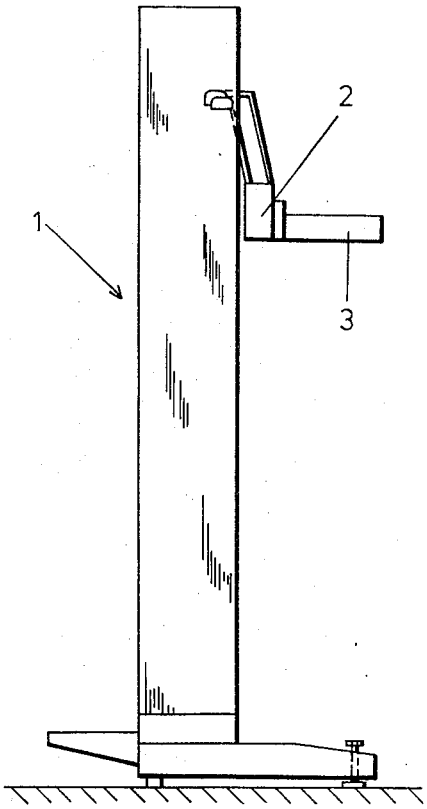
FIG. 1 is a schematic side view of a lifting device of the type to which the present invention relates.

Referring now to the drawings, wherein an exemplary embodiment of the present invention is depicted, there is shown a lifting device 1 which may, of course, be configured with regard to the details thereof in different structural arrangements. The device depicted relates to a lifting device which may be equipped, for example, with rollers so that it may be transported to appropriate places by a worker. The lifting device 1 includes a lifting or support structure 2 wherein lifting is effected hydraulically, pneumatically, electrically or mechanically. Of course, a device similar to that of the present invention may also be used in connection with motor-driven lifting devices which have similar types of support arms.

In order to support a load, the lifting device 1 is provided with support arms 3 which, as shown, are located proximate the horizontal extremeties of the lifting or support structure 2. The support arms 3 are detachably connected with the support structure 2 and for this purpose the support arms 3 and/or the adjustable support structure 2 are provided with corresponding suspension means and centering means which engage to assure the desired connection.

The suspension and centering means which essentially comprise means for connecting the support arms 3 with the support structure 2 are provided in opposed contact areas between the support arm 3 and the support structure 2 and there is included a suspension portion or hooked member 4 which projects with a hooked configuration. Additionally, there is provided an approximately horizontally extending cantilevered bolt 5 which functions to center the support arm 3.

Figure 4:
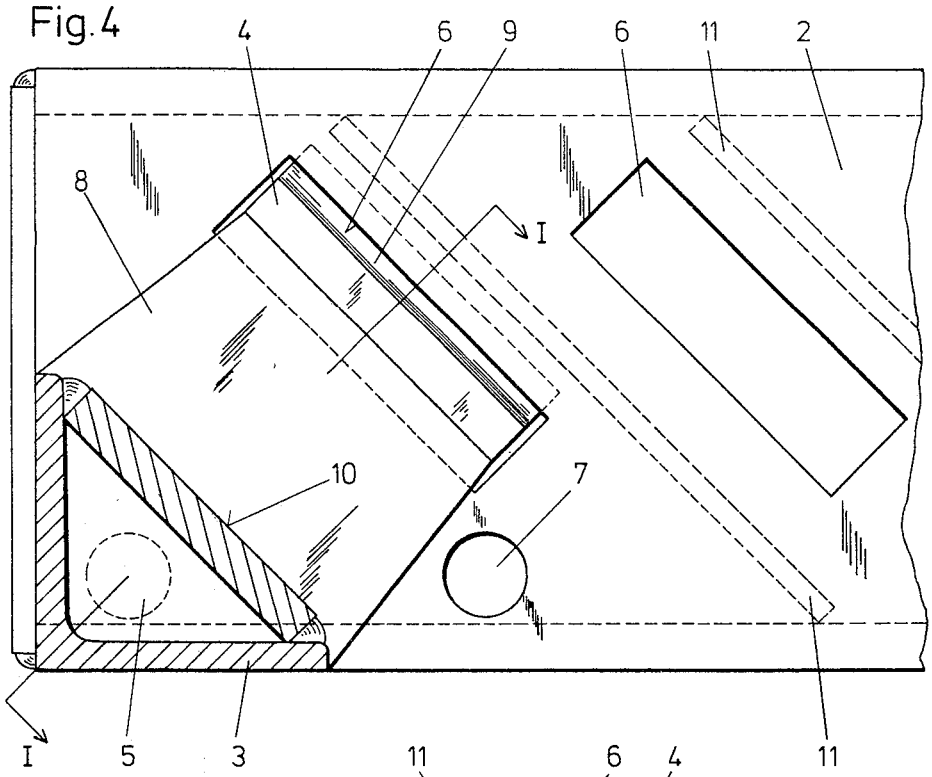
FIG. 4 is an enlarged detail view partially in section of a portion of the lifting device.
Figure 5:
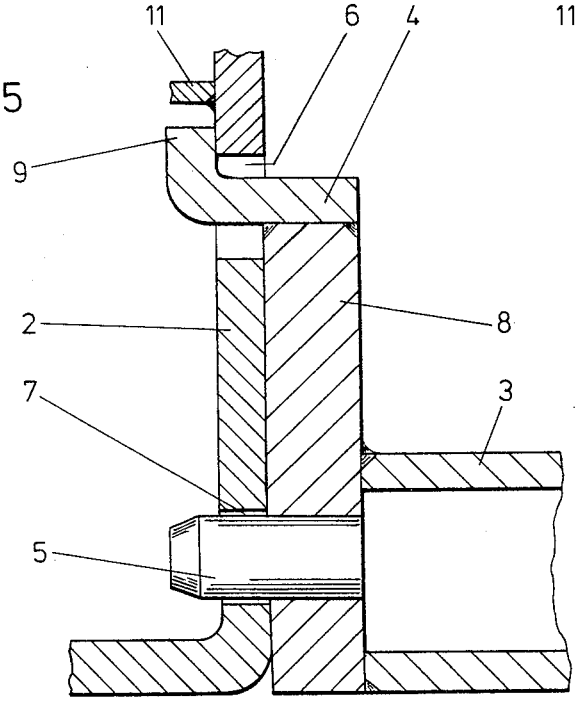
FIG. 5 is a cross-sectional view taken along the line I—I of FIG. 4.

At the corresponding opposite part, slots 6 and/or apertures 7 are provided. In the specific embodiment shown in FIGS. 4 and 5, at the end of the support arm 3 facing the support structure 2, a contact plate 8 is provided which projects upwardly and extends perpendicularly to the longitudinal extension of the arm. At the upper free edge of the contact plate 8, there is provided a suspension portion 4 which is attached thereto and which is constructed of an approximately L-shaped configuration. In the bottom peripheral area of the contact plate 8 the bolt 5 is inserted to extend or cantilever in the same direction as the suspension portion 4. In the support structure 2 there is formed an aperture 7 located at a corresponding position to the bolt 5, with a slot 6 being provided in the support structure 2 for insertion of the suspension portion 4.

As a result of the embodiment of the invention depicted, the support arm 3 may be attached in a simple manner to the support structure 2 and it may be again removed with ease. Nevertheless, when the support arm 3 is applied in its mounted position an appropriate secure fixation will be insured. During placement of the support arm 3, first the suspension portion 4 is inserted into the slot 6 whereupon due to the upward movement of the support arm, a part 9 of the suspension portion 4 will project upwardly and will engage behind the upper edge boundary of the slot 6. When the contact plate 8 is placed in this position the bolt 5 will be aligned with the aperture 7 and may be inserted therein. In order to enable a simple insertion of the suspension 4, the width of the slot 6 is made equal to or slightly larger than the length of the suspension portion 4. It should also be taken into consideration that insertion of the portion 4 must occur with the contact plate 8 held in a relatively oblique position inasmuch as the bolt 5 may only engage in the opening or aperture 7 after insertion of the suspension portion 4 into the slot 6.

The suspension portion 4 and the bolt 5 are expediently arranged symmetrically with respect to the plane of symmetry of the supporting arm 3 and this provides a special effect with regard to favorable absorption of a load to be supported. The forces acting upon the supporting arm will also always tend to extend basically in the direction of a median plane of symmetry.

Figure 2:
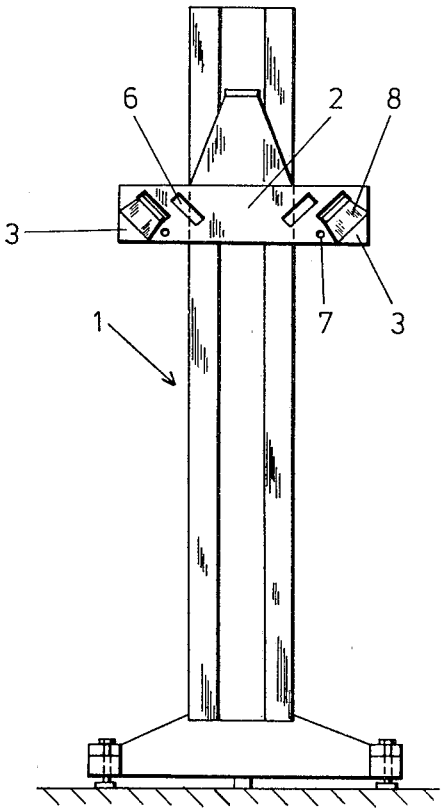
FIG. 2 is a front view of the device of FIG. 1.
Figure 3:
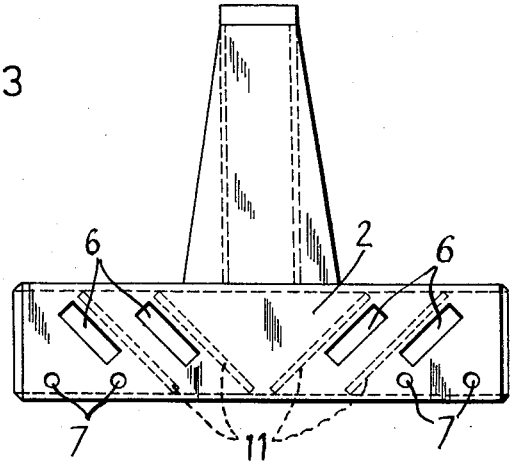
FIG. 3 is a partial front view of a vertically adjustable lifting structure of the lifting device.

At the support structure 2, as seen in the horizontal direction, there are provided apertures 7 and slots 6 at both end areas or horizontal terminations so that two supporting arms 3, as best seen in FIG. 2, may be attached with an appropriate space provided therebetween. In order to ensure that variations are possible, there may be provided at the end areas of the support structure 2 two or more slots 6 and apertures 7 which may be arranged in a staggered system relative to each other. Depending upon the loads which are to be lifted, the support arms 3 may therefore be suspended at the lifting structure with varying degrees of spacing being provided therebetween.

Of course, it will be apparent that at any given support arm, two or more suspension portions and bolts may be provided and correspondingly a similar number of slots and openings may also be provided. It is also possible that two supporting arms, arranged at an appropriate distance from the other, may be rigidly joined with each other by means of a connecting bar whereby a unit could be formed having two or more suspension portions and bolts.

In the embodiment depicted, the slots 6 extend obliquely relative to the horizontal and a plane extending through the center of the slot 6 and through the opening 7 represents a mutual plane of symmetry. It is advantageous that the slots be arranged to extend at an angle approximately 45° to the horizontal. This measure is found especially practical when the support arms must be utilized to engage and lift vehicle tires or vehicles which are to be lifted by holding or supporting them at the wheels. In this way, an adjustment of the direction of the acting forces is possible. Especially, for such a measure, the support arms 3 may correspond in their cross-sectional configuration to an isosceles triangle wherein the boundary surface 10 on the side of the hypotenuse of such a triangle may extend parallel to the longitudinal extension of the suspension portion 4 in order to form at the same time a supporting surface for the support arm 3.

In order to increase the stability of the lifting structure in the suspension area, it may also be provided that in the area of the slot reinforcing strips 11 or reinforcement sections may be attached, preferably by welding.

In the preceding description it has been indicated that the suspension portion 4 and the bolts 5 are staggered at the support arm 3 and the slots 6 and the openings 7 are arranged at the lifting or support structure 2. It will be apparent that the locations of these parts can be reversed at random so that, for example, the suspension portion 4 and the bolt 5 may be arranged on the lifting or support structure 2 with the slot 6 and the opening 7 being arranged at the support arm 3. Also, partial modifications are possible and for instance the suspension portion 4 may be attached at the support arm 3 and the bolt 5 at the lifting or support structure 2, wherein the slot 6 would be provided at the lifting structure 2 and the opening 7 provided at the support arm 3.

The cross section of the bolt 5 may of course be structured in different ways and a rectangular or plate-like contstruction is possible. Furthermore, other forms of cross-sectional configurations are conceivable.

A significant and important aspect of the arrangement of the suspension portion 4 and the bolt 5 relates to the fact that by utilization of the bolt 5 the position of mounting and of suspension of the suspension portion 4 is insured.

While a specific embodiment of the invention has been shown and described in detail to illustrate the application of the inventive principles, it will be understood that the invention may be embodied otherwise without departing from such principles.

What is claimed is:

1. A lifting device for transporting loads including a generally vertically extending support structure, at least one approximately horizontally extending support arm cantilevered from said support structure, and attachment means for connecting said support arm with said support structure, said attachment means comprising: a contact plate affixed to said support arm at an end thereof proximate said support structure and extending relative to said support arm perpendicularly to the longitudinal extension thereof; a hooked suspension portion affixed to one of said support structure and said contact plate; a slot formed in the other of said support structure and said contact plate, said slot being configured to receive said hooked suspension portion therein; a bolt affixed to one of said support structure and said contact plate; and an aperture defined in the other of said support structure and said contact plate and located to receive said bolt therein when said hooked suspension portion is engaged within said slot; said bolt and said aperture being located beneath said hooked suspension portion and said slot when said support arm is connected with said support structure by said attachment means; said other of said support structure and said contact plate being provided with a plurality of said apertures and said slots spaced apart horizontally each adapted to receive therein, respectively, said bolt and said suspension portion, said plurality of openings and slots being arranged in a formation staggered with respect to each other.

2. A lifting device according to claim 1 wherein said suspension portion and said bolt are arranged symmetrically with respect to a median plane of symmetry of said support arm.

3. A lifting device according to claim 1 wherein the width of said slot is dimensioned to be at least equal to the width of said suspension portion in order to facilitate insertion of said suspension portion within said slot.

4. A lifting device according to claim 1 wherein said slots are formed to extend obliquely relative to the horizontal and wherein a plane extending through the center of said slots and through said opening represents a mutual plane of symmetry thereof.

5. A lifting device according to claim 4 wherein said slots extend at approximately 45° relative to the horizontal.

6. A lifting device according to claim 1 comprising a plurality of support arms, each of said support arms being formed of rectangular members arranged to form said support arm in the shape of an isosceles triangle, taken in the cross section thereof, and wherein said support arm is thereby formed with a boundary surface on one side of said triangle which extends parallel to the longitudinal extension of said suspension portion and which forms at the same time the support surface for said support arm.

* * * * *